United States Patent [19]

Schumacher et al.

[11] 4,039,356

[45] Aug. 2, 1977

[54] GALLING RESISTANT AUSTENITIC STAINLESS STEEL

[75] Inventors: William J. Schumacher; Harry Tanczyn, both of Baltimore, Md.

[73] Assignee: Armco Steel Corporation, Cincinnati, Ohio

[21] Appl. No.: 552,357

[22] Filed: Feb. 24, 1975

Related U.S. Application Data

[62] Division of Ser. No. 360,402, May 14, 1973, Pat. No. 3,912,503.

[51] Int. Cl.[2] ..... C22B 35/00; C22C 38/40

[52] U.S. Cl. ..... 148/31.5; 75/125; 75/128 A; 75/128 C; 148/38; 148/12 E; 148/136

[58] Field of Search ..... 75/128 A, 128 C, 125; 148/12, 31.5, 38, 136

[56] References Cited

U.S. PATENT DOCUMENTS

| | | | |
|---|---|---|---|
| 2,177,454 | 10/1939 | Frevert et al. | 75/128 A |
| 2,484,903 | 10/1949 | Payson | 75/128 A |
| 2,687,955 | 8/1954 | Bloom | 75/128 A |
| 2,820,708 | 1/1958 | Waxweiler | 75/128 C |
| 3,152,934 | 10/1964 | Lula et al. | 75/128 A |
| 3,615,368 | 10/1971 | Baumel | 75/128 A |
| 3,726,668 | 4/1973 | Baumel | 75/128 C |
| 3,806,337 | 4/1974 | Jones | 75/128 A |
| 3,912,503 | 10/1975 | Schumacher et al. | 75/125 |

FOREIGN PATENT DOCUMENTS

| | | | |
|---|---|---|---|
| 1,950,932 | 2/1971 | Germany | 75/128 A |
| 1,202,479 | 8/1970 | United Kingdom | 75/128 A |

*Primary Examiner*—Walter R. Satterfield

[57] ABSTRACT

An austenitic stainless steel having excellent galling resistance by reason of a silicon-containing surface oxide film and a high work hardening rate, good wear resistance, good corrosion resistance in chloride-containing environmets, and excellent oxidation resistance, containing 10% to 25% chromium, 3% to 15% nickel, 6% to 16% manganese, 2% to 7% silicon, 0.001% to 0.25% carbon, 0.001% to 0.4% nitrogen, and balance iron except for incidental impurities. Up to 4% molybdenum, up to 4% copper, 0.09% maximum phosphorus, up to 0.25% maximum sulfur and up to 0.50% maximum selenium may be present. The steel is readily workable on ordinary equipment into plate, sheet, strip, bar, rod and like wrought products.

4 Claims, No Drawings

GALLING RESISTANT AUSTENITIC STAINLESS STEEL

This is a division of application Ser. No. 360,402 filed May 14, 1973 now U.S. Pat. No. 3,912,503.

BACKGROUND OF THE INVENTION

1. Field of the Invention

This invention relates to an austenitic stainless steel having excellent galling resistance in conventional wrought form, good wear resistance, good corrosion resistance in chloride-containing environments, excellent high temperature oxidation resistance, and a high work hardening rate. The alloy of this invention can be readily worked with conventional equipment into plate, sheet, strip, bar, rod and the like, and retains a substantially austenitic structure throughout a wide temperature range.

The steel of the invention is adapted to applications in which moving metal-to-metal contact and corrosive attack are encountered in combination. Although not so limited, the steel has particular utility for fabrication into roller chains, link belts on conveyors, valves subjected to elevated temperature, woven metal belts for continuous heat treating furnaces, fasteners, pins and bushings.

2. Description of the Prior Art

Although galling and wear may occur under similar conditions, the types of deterioration involved are not similar. Galling may be defined as the development of a condition on a rubbing surface of one or both contacting metal parts wherein excessive friction between minute high spots on the surfaces results in localized welding of the metals at these spots. With continued surface movement this results in the formation of even more weld junctions which eventually sever in one of the base metal surfaces. The result is a build-up of metal on one surface, usually at the end of a deep surface groove. Galling is thus associated primarily with moving metal-to-metal contact and results in sudden catastrophic failure by seizure of the metal parts.

On the other hand, wear is synonymous with abrasion and can result from metal-to-metal contact or metal to nonmetal contact, e.g. the abrasion of steel mining equipment by rocks and similar mineral deposits. Such wear is characterized by relatively uniform loss of metal from the surface, as contrasted to localized grooving with consequent metal build-up, as a result of rubbing a much harder metallic surface against a softer metallic surface. The distinction between galling and wear can perhaps best be illustrated by the fact that galling can be eliminated by mating or coupling a very hard metallic surface with a much softer metallic surface, whereas wear or abrasion in metal-to-metal contact would be increased by mating a very hard surface with a much softer one.

An article by Harry Tanczyn entitled "Stainless Steel Galling Characteristics Checked" in STEEL, Apr. 20, 1954 points out that stainless steel sections at a relatively high hardness level, or with substantial difference in hardness, exhibit better resistance to galling than the combination of two soft members. This may be explained by the theory that the hardened sections deform elastically near the contact points under loading, while the softer pieces yield plastically for a significant distance beneath the contact points. During movement, the hardened surfaces apparently recover elastically with decrease in pressure, and this motion tends to sever any metallic welding. This article also indicates that good resistance to galling may be traceable to the combination of a suitable oxide surface film and a hard backing. Oxide films were found to influence the galling characteristics of metals, e.g. a film of $Fe_3O_4$ increased the resistance of mild steel to galling, while a film of $Fe_2O_3$ did not benefit resistance to galling.

Among the numerous prior art steels currently available, the austenitic AISI Type 304 is suited to a variety of uses involving welding and fabrication, but the galling and wear resistance of this steel are poor, and the metal is likely to fail when subjected to such conditions.

A precipitation-hardening stainless steel, sold under the registered trademark ARMCO 17-4 PH (about 16.5% chromium, about 4.0% nickel, about 4.0% copper, about 1.0% manganese, about 1.0% silicon, up to 0.07% carbon, 0.35% columbium, and remainder iron), while possessing high strength and hardness in the hardened condition, exhibits only fair galling and wear resistance.

United States Pat. No. 3,663,215, issued May 16, 1972 to H. Tanczyn, discloses a steel having improved wear resistance, which at the same time is weldable, workable, and/or machinable, and precipitation hardenable by heat treatment to great hardness. It has been found that this steel has good galling resistance. However, it contains large amounts of expensive alloying elements, and it is difficult to process with standard steel mill equipment. The broad composition ranges are about 10% to about 22% chromium, about 14% to about 25% nickel, about 5% to about 12% silicon, one or more of the elements molybdenum up to about 10%, tungsten up to about 8%, vanadium up to about 5%, columbium up to about 5% and titanium up to about 5%, these additional elements being in sum total of about 3% to about 12%. Carbon is present up to about 0.15% and nitrogen up to about 0.05%. In this alloy silicon is stated to form silicides of molybdenum, tungsten and the like, in finely dispersed form in the matrix of the precipitation-hardened steel. These silicides are of extreme hardness, thereby providing good wear resistance.

A prior art steel presently considered to have the best resistance to wear and galling is the straight chromium AISI Type 440C, containing about 16% to 18% chromium, about 1% maximum manganese, about 1% maximum silicon, about 0.75% maximum molybdenum, about 0.95% to 1.20% carbon, and remainder iron. This steel is hardenable by heat treatment but has poor corrosion resistance and poor formability. It is difficult to roll into plate, strip, sheet, bar or rod, and articles of ultimate use cannot be readily fabricated from plate, sheet, strip, bar or rod form.

Reference is further made to Ser. No. 445,482 filed Feb. 25, 1974 as a continuation of Serial No. 238,862 filed Mar. 28, 1972, now abandoned (as a C-I-P of Ser. No. 868,893 filed Oct. 23, 1969, now abandoned) in the names of George N. Goller and Ronald H. Espy and assigned to the assignee of the present application. This application discloses and claims an austenitic stainless steel having excellent stress corrosion cracking resistance, good weldability, good cryogenic strength and toughness, and high strength at room temperature resulting from a high work hardening rate. This alloy has been found to possess good galling and wear resistance. Its broad composition comprises from about 15.5 to about 20% chromium, from about 11% to about 14% manganese, from about 1.1% to about 3.75% nickel, from about 0.01% to about 0.12% carbon, from about 0.20% to about 0.38% nitrogen, up to about 1% silicon, up to about 0.06% phosphorus, up to about 0.04% sulfur, and remainder substantially iron.

From the above background of the present state of the art, it is apparent that there is not now available an alloy having excellent galling resistance in wrought form, good wear resistance, good corrosion resistance to chloride-containing environments, good high temperature oxidation resistance, and which is readily workable into plate, sheet, strip, bar, rod and like wrought products.

SUMMARY

It is therefore an object of the present invention to provide an austenitic stainless steel having the above-mentioned combination of properties and which at the same time contains a relatively low level of expensive alloying ingredients.

In broad composition the steel of the present invention consists essentially of about 10% to about 25% chromium, about 3% to about 15% nickel, about 6% to about 16% manganese, about 2% to about 7% silicon, about 0.001% to about 0.25% carbon, about 0.001% to about 0.4% nitrogen, up to about 4% molybdenum, up to about 4% copper, a maximum of about 0.09% phosphorus, a maximum of about 0.25% sulfur, a maximum of about 0.50% selenium, and balance substantially iron except for incidental impurities, all percentages being by weight.

The elements chromium, nickel, manganese, silicon, and nitrogen, and the balance therebetween, are critical in every sense. Omission of one of the elements, or departure of any of these critical elements from the ranges set forth above results in loss of one or more of the desired properties. Nickel is varied directly in proportion to the silicon content, for reasons set forth hereafter.

The silicon content of the steel of the invention is of particular criticality. Although not wishing to be bound by theory, it is believed that silicon within the range of 2% to 7%, and more particularly within the range of 3% to 5% by weight, performs a dual function. First, it appears to modify the composition of the surface oxide film of the steel, making it more stable and adherent. Secondly, silicon exerts a significant influence on the work hardening rate of the steel. An increase in silicon within the limits set forth above results in an increase in the work hardening rate.

Unlike the steel of the above mentioned U.S. Pat. No. 3,663,215, silicon does not form a silicide of molybdenum, tungsten, vanadium, columbium and/or titanium which silicide is relied upon to impart wear resistance in the steel of that patent. Instead, the silicon present in the surface oxide film is believed to be dispersed as a substitutional atom in the oxide lattice providing a low shear strength oxide film which is tightly adherent to the surface. Moreover, upon removal of the surface oxide film, as by abrasion, another oxide film rapidly forms at ordinary temperatures, so that the surface, is in effect, "self-healing."

DESCRIPTION OF THE PREFERRED EMBODIMENTS

Preferred and more preferred compositions of the steel of the invention are as follows, all percentages being by weight:

| | Preferred | More Preferred |
|---|---|---|
| chromium | 12 - 19 | 15 - 17 |
| nickel | 4 - 12 | 6 - 10 |
| manganese | 7 - 13 | 7.5-8.5 |
| silicon | 3 - 5 | 3.7-4.2 |
| carbon | 0.01-0.12 | 0.05-0.10 |
| nitrogen | 0.03-0.3 | 0.10-0.20 |
| phosphorus | 0.09 max. | 0.07 max. |
| sulfur | 0.05 max. | 0.03 max. |
| molybdenum | 0.75 max. | 0.5 max. |
| copper | 0.75 max. | 0.5 max. |
| iron | balance | balance |

Where good machinability is desired, the above compositions are modified by addition of sulfur in amounts of about 0.15% to 0.25%, and/or selenium in amounts of about 0.25% to 0.50%.

At least 10% chromium is required for corrosion resistance. More than 25% chromium results in extreme difficulties in processing, and disturbs the austenitic balance of the alloy. For many applications a maximum of 19%, or even 17%, chromium should be observed in order to insure a substantially fully austenitic structure.

Nickel is an austenite former, and at least 3% nickel is required in order to assure an austenitic structure. Preferably 4%, and more preferably 6%, nickel is added for this purpose. Since silicon is a ferrite former, nickel is added in direct proportion to the silicon content, e.g. when silicon is low, nickel is low. A maximum of 15%, or still better, 13% by weight nickel must be observed since hot workability of the steel is adversely affected with nickel in amounts exceeding about 13% and certainly above 15%. It is of course also evident that large amounts of nickel greatly increase the cost of the alloy. Preferably a maximum of 12% nickel is observed for a preferred maximum silicon content of 5%, while a maximum of 10% nickel is preferred for the more preferred maximum silicon content of 4.2%.

As indicated above, silicon is essential in an amount of at least 2% for its effect in making the surface oxide layer more stable and adherent. Moreover, it has been found that an increase in the silicon content increases the work hardening rate of the steel of the invention. However, this effect is somewhat mitigated due to the necessity to increase the nickel directly in proportion to the increased silicon content (to offset the ferrite-forming potential of silicon), and an increase in the nickel content tends to lower slightly the work hardening rate of the steel. The net effect, however, is an increase in the work hardening rate as the silicon content is increased. At least 3% silicon is preferred for these reasons, and the more preferred minimum is 3.7% silicon. However, since silicon is a ferrite former, more than 7% silicon cannot be tolerated, at the nickel levels herein contemplated, in order to insure a substantially austenitic structure. Moreover, a silicon content in excess of 7% adversely affects hot workability, and for best cold formability the silicon content should not exceed 5%. For optimum properties the maximum silicon content is about 4%.

Although manganese is a weak austenite former, it is present primarily for its effect in stabilizing the austenitic structure of the steel and in keeping nitrogen in solid solution. For these purposes, at least about 6% manganese is essential. More than about 16% manganese would upset the composition balance and would lower the general corrosion resistance of the steel. Preferably a maximum of 13%, and even more preferably a maximum of 8.5%, are observed with the chromium, nickel and silicon ranges set forth above.

Nitrogen is present, the minimum being about 0.001%, and a purposeful addition is preferably made for its effects as an austenite former and in strengthening and work hardening the steel. Low nitrogen levels have no noticeable benefit, while a maximum of 0.4% nitrogen must be observed in order to avoid exceeding the solubility limits of nitrogen in the steel. Optimum benefits are realized with nitrogen present in the range of 0.03% to 0.3%, or even better within the range 0.10%–0.20%.

Molybdenum and/or copper may be present up to a maximum of 4% each for improving high temperature properties and corrosion resistance. Where such improved properties are not needed, a preferred maximum of 0.75%, and more preferred maximum of 0.5%, for each element are observed.

Carbon is of course present as an impurity, and ordinarily will amount to at least about 0.001%. Carbon should be restricted to a maximum of about 0.25%, preferably about 0.12%, and even more preferably about 0.10% maximum, since excessive carbon adversely affects corrosion resistance and weldability.

Phosphorus is held to 0.09% maximum for welding and hot working reasons. Sulfur may be added up to 0.25% maximum (and/or selenium up to 0.50% maximum) for good machinability.

While the steel of the present invention exhibits good wear resistance, its outstanding and principal property is its resistance to galling.

EXAMPLE I

An exemplary heat has been prepared consisting essentially of 16% chromium, 7.4% nickel, 8% manganese, 4% silicon, 0.09% carbon, 0.14% nitrogen, 0.010% phosphorus, 0.014% sulfur, 0.02% molybdenum, 0.04% copper, and balance iron. The heat was melted in an induction furnace, cast into an ingot, hot rolled on a conventional rolling mill to intermediate size and hot rolled to final 1 inch diameter, annealed at 1850° F for ½ hour and water quenched.

The annealed bar stock of Example I was subjected to galling and wear resistance tests. Test results on galling resistance are summarized in Table I. For purposes of comparison a number of prior art alloys were tested under the same conditions and reported in Table I below.

TABLE I

Galling Properties
Unlubricated Tests

| Couple and (Brinell Hardness) | Galling Stress ksi |
|---|---|
| Example 1 (200)* v. Example 1 (216)* | 63** |
| Example 1 (216)* v. AISI 304 (140) | 54 |
| Example 1 (200)* v. AISI 430 (190) | 36 |
| Example 1 (200)* v. AISI 440C (555) | 64** |
| Example 1 (200)* v. AISI 4337 (283) | 64** |
| AISI 304 (140) v. AISI 304 (140) | 3 |
| AISI 316 (152) v. AISI 316 (152) | 4 |
| AISI 410 (375) v. AISI 410 (375) | 20 |
| AISI 440C (555) v. AISI 44CC (555) | 36 |
| AIsi 430 (156) v. AISI 430 (156) | 4 |
| S.N. 238,862 (235) v. S.N. 238,862 (235) | 22 |
| S.N. 238,862 (235) v. AISI 304 (140) | 6 |
| AISI 4337 (509) v. AISI 4337 (509) | 3 |

* Steel of the present invention.
** No galling; exceeded limits of test machine.

The test method utilized in obtaining the data of Table I involved rotation of a polished cylindrical section or button for one revolution under pressure against a polished block surface in a standard Brinell hardness machine. A button specimen was prepared by drilling a countersunk hole to accommodate most of the exposed Brinell hardness ball, the specimen then being mounted in bakelite and polished to a 600 grit finish in a Buehler Automet unit to obtain a relatively flat test surface, with the edges slightly rounded. The button was then broken out of the bakelite and the edges were hand deburred. A block specimen was ground parallel on two sides and hand polished to a 3/0 emery grit finish, equivalent to a 600 grit finish. Both the button and block specimens were degreased by wetting with acetone, and the hardness ball was lubricated just prior to testing. The button was hand-rotated slowly at a predetermined load for one revolution and examined for galling at 10x magnification. If galling was not observed (i.e. absence of metal build-up, usually at the end of a groove) a new button and block area couple was tested at successively higher loads until galling was first observed. Confirmation was obtained by testing one more couple or combination at a higher load. Since light loads did not cause full area contact due to the rounded button edges, the actual contact area was measured at 10X to convert to galling stress.

In Table I the button specimen is the first alloy mentioned in each couple and the second alloy is the block specimen. Double asterisks beside the galling stress indicate that the test was terminated at that point because the limits of the test equipment were exceeded.

The data of Table I show that the steel of the present invention does not gall when rotated against itself at stresses as high at 63 ksi, even though the Brinell hardness is only about 200. In contrast to this, AISI Types 410 and 4337, having Brinell hardness values of 375 and 509 respectively, gall on themselves at stresses of only 20 and 6 ksi respectively. The best prior art alloy currently available, viz. AISI Type 440C, galls on itself at a stress of 36 ksi, depite the extremely high Brinell hardness of 555. The steel of the above mentioned Ser. No. 238,862 filed in the names of G. N. Goller and R. G. Espy, (test specimen analyzing 18.0% chromium, 1.60% nickel, 12.0% manganese, 0.10% carbon, 0.34% nitrogen, and remainder iron) galls when rotated against itself at a stress of only 22 ksi, although the Brinell hardness (235) was about the same as that of the steel of the invention.

The outstanding superiority against galling resistance of the steel of the invention when rotated against itself is thus clearly demonstrated.

Another highly significant feature of the data of Table I is the fact that conventional alloys such as AISI Types 304, 420, 440C and 4337 can sustain much higher galling stresses when mated against the steel of the present invention rather than against themselves. Of the above mentioned standard alloys, only Type 430 and Type 304 showed actual galling when mated or coupled against the steel of the present invention, and even here galling occurred at a stress of 36 ksi and 54 ksi, respectively, as compared to a stress of 4 ksi when Type 430 was rotated against itself and 3 ksi when Type 304 was rotated against itself. It is of further significance to note that the steel of Ser. No. 238,862 was ineffective in preventing galling of AISI Type 304 at a stress above 6 ksi.

In connection with the reported hardness of the steel surfaces, it should be recognized that the hardness determination was made prior to subjecting the specimens to rotation under load. Since the steel of the invention has a rapid work hardening rate, hardening occurred as a result of the applied stress, so that the final hardness after one revolution must be considered to be substantially higher than the reported values, insofar as the steel of the present invention is concerned. It is of course apparent that the same effect would be obtained when an article of ultimate use is subjected to stress or load, i.e. the article would work-harden when placed in actual operation in a metal-to-metal contact situation.

It should further be recognized, as indicated above, that an oxide surface film containing silicon reforms rapidly after the specimen is polished for testing. Accordingly, both the surface film and the rapid work hardening combine to achieve the outstanding galling resistance of the steel of the invention.

Wear and hardness tests are reported in Table II below. Again, for purposes of comparison, a number of prior art alloys were tested under the same conditions. In Table II a wear index of 1.00 for AISI Type 316 was taken as a basis for comparison. Values higher than 1.00 have poorer wear resistance than Type 316, and values lower than 1.00 have better wear resistance than Type 316.

In Table II metal-to-metal abrasive wear resistance was determined on the LFW-1Wear Machine under the following conditions:

Rockwell C hardness 64 carburized ring, water lubricant, 30-pound lead, 3300 feet, 300 RPM.

TABLE II

Wear Properties

| Sample | Rockwell Hardness | Wear Index |
|---|---|---|
| Example 1* | Rb 96 | 0.30 |
| AISI 440C | Rc 59 | 0.003 |
| S.N. 238,862** | Rb 92 | 0.30 |
| Armco 17-4PH | Rc 42 | 0.51 |
| AISI 316 | Rb 78 | 1.00 |
| AISI 304 | Rb 78 | 1.00 |
| Armco 17-4PH | Rc 32 | 1.09 |
| AISI 416 | Rc 38 | 3.69 |

*Steel of the present invention.
**Analysis the same as Table I specimens.

It is apparent from Table II that the steel of the present invention exhibits wear resistance superior to that of AISI Types 416, 304, 316 and Armco 17-4pH while the wear resistance of the steel of Ser. No. 238,862 is the same as that of the steel of this invention. Although AISI Type 440C exhibits superior wear resistance to that of the present steel, this prior art alloy is rolled with difficulty into plate, strip, sheet, bar or rod, i.e. conventional wrought form, and has relatively poor corrosion resistance.

All the tests reported in Tables I and II were conducted at ambient temperature. However, the steel of the invention retains its greatly superior galling resistance at much higher temperatures. For example, cyclic internal combustion engine tests at temperatures up to 1400° F were conducted by an automobile manufacturer and it was observed that all the standard stainless steels failed catastrophically by seizing and galling in less than six hours. In contrast, the steel of the invention showed no galling during the entire duration of the test, which was 200 hours.

The corrosion resistance of the steel of the invention was compared to that of AISI Type 304, which is generally considered to have corrosion resistance adequate for most applications. These comparisons are set forth in Table III below.

TABLE III

Corrosion Properties

| | | Example 1* | AISI 304 |
|---|---|---|---|
| 65% boiling $HNO_3$ | IPM | 0.006 | 0.0010 |
| 1% HCl at 35° C | IPY | 0.038 | 0.240 |
| 2% $H_2SO_4$ at 80° C | IPY | 1.40 | 0.480 |
| 10% Fe $Cl_3$ at RT (pitting test) | $gm/in^2$ | 0.050 | 0.310 |

*Steel of the present invention

From the above data it will be evident that the steel of the invention has corrosion resistance comparable to that of Type 304 in boiling 65% nitric acid. In 2% sulfuric acid the steel of the invention has slightly poorer corrosion resistance than Type 304. In chloride containing environments especially those causing pitting, the steel of the present invention has substantially greater resistance to attack than Type 304. This greatly increased resistance to attack by chlorides is believed to be due to the silicon-containing oxide film on the steel of the invention.

Comparative data on high temperature oxidation resistances are shown below in Table IV.

TABLE IV

Oxidation Properties
Weight Loss in $mg/cm^2$

| | 1900° F | 2000° F | 2100° F | 2200° F |
|---|---|---|---|---|
| Example 1 | — | 11.0 | 13.7 | 15.8 |
| AISI 304 | 270.0 | — | 880.0 | — |
| AISI 310* | — | 9.7 | 9.9 | 13.0 |
| RA333* | — | 5.7 | 8.4 | 12.9 |

*Melting specifications: 0.25% max. carbon, 24–26% chromium, 19–22% nickel, 2% max. manganese, 1.5% max. silicon, balance iron.
**Test sample analyzed 0.05% carbon, 25% chromium, 45% nickel, 1.5% manganese, 1.25% silicon, 3.0% cobalt, 3.0% tungsten, 3.0% molybdenum, 18% iron.

The test results on galling resistance and oxidation resistance at elevated temperatures show that the steel has great utility for fabrication into components and parts of power generating equipment involving fuel ignition (for example, exhaust valves in internal combustion engines), such environments requiring excellent galling resistance, excellent oxidation resistance, and high strength at temperatures up to 1400° F.

This invention therefore provides an austenitic stainless steel having excellent galling resistance, good wear resistance, good corrosion resistance against chloride-containing environments, especially pitting environments, and excellent high temperature oxidation resistance. Moreover, the steel can easily be worked with standard equipment into plate, sheet, strip, bar or rod, and such wrought products can be fabricated readily into ultimate useful products.

In the annealed condition, wrought products of the present steel are sufficiently soft and ductile to permit ready fabrication into chains, valves, woven metal belts, fasteners of various types, and other articles of ultimate use wherein metal-to-metal contact under stress or load would be encountered. The steel of the invention can readily be welded or brazed and may be cut, drilled, tapped, threaded and machined in other manner in fabrication of articles of ultimate use.

While certain preferred embodiments of the invention have been specifically disclosed and described, it should be understood that the invention is not limited thereto, since many variations will be apparent to those skilled in the art, and the invention is to be given its broadest interpretation within the terms of the following claims.

The embodiments of the invention in which an exclusive property or privilege is claimed are defined as follows:

1. An annealed, austenitic stainless steel wrought product formed from a stainless steel exhibiting no galling at stress of 63 ksi when rotated against itself in the form of button and block specimens in accordance with the test method described herein, said steel consisting essentially of, in weight percent, from about 12% to about 19% chromium, from about 4% to about 12% nickel, from about 7% to about 13% manganese, from about 3% to about 5% silicon, from about 0.01% to about 0.12% carbon, from about 0.03% to about 0.3% nitrogen, about 0.75% maximum molybdenum, about 0.75% maximum copper, about 0.09% maximum phosphorus, about 0.05% maximum sulfur, and remainder essentially iron, said product having a low shear strength oxide film containing silicon formed in air at ordinary temperatures, the nickel content being varied directly in proportion to the silicon content in such manner as to assure an austenitic structure.

2. The product of claim 1, consisting essentially of from about 15% to about 17% chromium, from about 6% to about 10% nickel, from about 7.5% to about 8.5% manganese, from about 3.7% to about 4.2% silicon, form about 0.05% to about 0.10% carbon, from about 0.10% to about 0.20% nitrogen, about 0.5% maximum molybdenum, about 0.5% maximum copper, about 0.07% maximum phosphorus, about 0.03% maximum sulfur, and remainder essentially iron.

3. An austenitic stainless steel fabricated article formed from an annealed stainless steel exhibiting no galling at a stress of 63 ksi when rotated against itself in the form of button and block specimens in accordance with the test method described herein, said steel consisting essentially of, in weight percent, from about 12% to about 19% chromium, from about 4% to about 12% nickel, from about 7% to about 13% manganese, from about 3% to about 5% silicon, from about 0.01% to about 0.12% carbon, from about 0.03% to about 0.3% nitrogen, about 0.75% maximum molybdenum, about 0.75% maximum copper, about 0.09% maximum phosphorus, about 0.05% maximum sulfur, and remainder essentially iron, said article having a low shear strength oxide film containing silicon formed in air at ordinary temperatures, the nickel content being varied directly in proportion to the silicon content in such manner as to assure an austenitic structure.

4. The article claimed in claim 3, consisting essentially of from about 15% to about 17% chromium, from about 6% to about 10% nickel, from about 7.5% to about 8.5% manganese, from about 3.7% to about 4.2% silicon, from about 0.05% to about 0.10% carbon, from about 0.10% to about 0.20% nitrogen, about 0.5% maximum molybdenum, about 0.5% maximum copper, about 0.07% maximum phosphorus, about 0.03% maximum sulfur, and remainder essentially iron.

* * * * *